US006141954A

United States Patent [19]

Sowa et al.

[11] Patent Number: 6,141,954

[45] Date of Patent: Nov. 7, 2000

[54] PREMIXING FUEL INJECTOR WITH IMPROVED FLAME DISGORGEMENT CAPACITY

[75] Inventors: William A. Sowa, Simsbury; Donald W. Kendrick, Manchester; Louis M. Chiappetta, South Windsor, all of Conn.

[73] Assignee: United Technologies Corporation, Hartford, Conn.

[21] Appl. No.: 09/080,485

[22] Filed: May 18, 1998

[51] Int. Cl.[7] ..... F02C 7/20

[52] U.S. Cl. ..... 60/39.06; 60/737; 60/748; 239/400; 239/403; 431/173

[58] Field of Search ..... 60/39.06, 748, 60/737; 431/351, 354, 173; 239/400, 403, 419, 419.3, 424.5

[56] References Cited

U.S. PATENT DOCUMENTS

| | | | |
|---|---|---|---|
| 4,781,030 | 11/1988 | Hellat et al. | 60/743 |
| 4,932,861 | 6/1990 | Keller et al. | 431/8 |
| 5,169,302 | 12/1992 | Keller | 431/173 |
| 5,193,995 | 3/1993 | Keller et al. | 431/351 |
| 5,307,634 | 5/1994 | Hu | 60/737 |
| 5,461,865 | 10/1995 | Snyder et al. | 60/737 |
| 5,479,773 | 1/1996 | McCoomb et al. | 60/39.32 |
| 5,489,203 | 2/1996 | Dobbeling et al. | 431/173 |
| 5,671,597 | 9/1997 | Butler et al. | 60/737 |
| 5,761,897 | 6/1998 | Kramer | 60/39.06 |
| 5,791,562 | 8/1998 | Kramer et al. | 60/737 |
| 5,791,894 | 8/1998 | Dobbeling et al. | 431/350 |
| 5,896,739 | 4/1999 | Snyder et al. | 60/39.06 |
| 5,899,076 | 5/1999 | Snyder et al. | 60/737 |
| 5,921,766 | 7/1999 | Dobbeling et al. | 431/173 |
| 5,921,770 | 4/1999 | Sattelmayer | 431/352 |

FOREIGN PATENT DOCUMENTS

| | | |
|---|---|---|
| 0 321 809 B1 | 6/1989 | European Pat. Off. . |
| 0777 081 A2 | 6/1997 | European Pat. Off. . |
| 0 924 463 A2 | 6/1999 | European Pat. Off. . |

OTHER PUBLICATIONS

European Search Report for EP 99 30 3826.

*Primary Examiner*—Ted Kim
*Attorney, Agent, or Firm*—Kenneth C. Baran

[57] ABSTRACT

A premixing fuel injector for an industrial gas turbine engine includes an axially extending centerbody (58) and a pair of radially offset scrolls (18) bounding a mixing chamber (24). The leading end (28) of each scroll cooperates with the trailing end (34) of the neighboring scroll to define an intake slot (42) for admitting a stream of primary combustion air (44) tangentially into the mixing chamber. Fuel injection passages extend along each intake slot for injecting jets **(76*a*, 76*b*) of primary fuel into the incoming airstream (44). The injector is operable in a prescribed or normal state, and in a degraded state associated with the presence of undesirable combustion inside the mixing chamber. The fuel injection passages are oriented and positioned so that the fuel jets issuing therefrom are ineffective at sustaining the undesirable combustion for more than a limited interval of time. In one embodiment of the invention, the injection passages are positioned so that the trailing end (34)** of the neighboring scroll acts as a physical barrier to limit radial penetration of the fuel jets when the injector operates in the degraded state.

13 Claims, 3 Drawing Sheets

PREMIXING FUEL INJECTOR WITH IMPROVED FLAME DISGORGEMENT CAPACITY

CROSS REFERENCE TO RELATED APPLICATIONS

This application includes subject matter related to commonly owned copending U.S. patent applications Ser. No. 08/771,408, now U.S. Pat. No. 5,899,076, entitled "Flame Disgorging Two Stream Tangential Entry Nozzle" filed on Dec. 20, 1996, Ser. No. 08/771,409, now U.S. Pat. No. 5,876,739, entitled "Method of Disgorging Flames from a Two Stream Tangential Entry Nozzle" filed on Dec. 20, 1996, Ser. No. 08/991,032 entitled"Bluff Body Premixing Fuel Injector and Method for Premixing Fuel and Air", filed on Dec. 15, 1997, and Ser. No. 09/046,903 entitled "Improved Durability Flame Stabilizing Fuel Injector" filed on Mar. 24, 1998.

TECHNICAL FIELD

This invention relates to premixing fuel injectors for gas turbine engine combustion chambers, and particularly to a premixing fuel injector having superior capability to eliminate flame from the interior of the injector.

BACKGROUND OF THE INVENTION

Industrial gas turbine engines, such as those used for electrical power generation or as industrial powerplants, are subject to stringent regulation of exhaust emissions, particularly nitrous oxides (NOx), carbon monoxide (CO) and unburned hydrocarbons. In order to minimize undesirable exhaust emissions, industrial gas turbines are equipped with premixing fuel injectors in which fuel and air are thoroughly premixed prior to being discharged into the engine combustion chamber and burned. The thorough premixing of fuel and air ensures a uniformly low flame temperature, which is a prerequisite for suppressing NOx formation, and promotes complete combustion.

One type of premixing fuel injector is a tangential entry injector, examples of which are described in U.S. Pat. Nos. 5,307,634, 5,402,633, 5,461,865 and 5,479,773, all of which are assigned to the assignee of the present application. These injectors feature an annular mixing chamber radially bounded by an axially extending centerbody and a pair of circular arc scrolls. The scrolls are radially offset from each other to define a pair of intake slots, each of which admits a stream of air tangentially into the mixing chamber. Each scroll includes an array of fuel injection passages for introducing fuel into the incoming airstream. The air and fuel enter the mixing chamber, swirl around the centerbody and become intimately intermixed. The fuel-air mixture flows axially through the mixing chamber and discharges into the engine's combustion chamber where it is ignited and burned. Because the tangential entry injector produces a highly uniform, thoroughly blended fuel-air mixture, the injector is exceptionally effective at suppressing NOx formation and promoting complete combustion.

Premixing fuel injectors are called upon to exhibit a number of desirable operational characteristics in addition to thorough fuel and air mixing. For example, a premixing injector should promote spatial and temporal stability of the flame in the combustion chamber. Without such stability, the combustion chamber will be exposed to low frequency pressure oscillations that can stress the combustion chamber, reducing its useful life. In addition, a premixing fuel injector should be internally flame resistant. That is, the injector should resist ingestion of the combustion flame into the mixing chamber and quickly disgorge any flame that overcomes the ingestion resistance. Internal flame resistance is important because combustion inside the mixing chamber can easily damage the scrolls and centerbody, all of which have a limited tolerance for exposure to high temperatures.

Unfortunately, the requirements of thorough fuel-air mixing, flame stability in the combustion chamber, and internal flame resistance are often in conflict. Design features that improve one of these desirable attributes often compromise one or more of the others. Accordingly, achieving an effective combination of thorough fuel and air mixing, good flame stability, and internal flame resistance is a considerable challenge. A fuel injector having good internal flame resistance is described in copending, commonly owned patent applications Ser. No. 08/771,408, now U.S. Pat. No. 5,899,076, and Ser. No. 08/771,409, now U.S. Pat. No. 5,896,739 both filed on Dec. 20, 1996. The disclosed injector has a centerbody contoured so that the fuel-air mixture flows axially at a velocity high enough to resist flame ingestion and to promote flame disgorgement. Another exemplary injector is described in commonly owned copending patent application Ser. No. 08/991,032 filed on Dec. 15, 1997. The disclosed injector features a fuel passage array configured to inject fuel nonuniformly along the length of the air intake slot to improve the uniformity of the fuel-air mixture and thereby suppress undesirable exhaust emissions. The injector also features a centerbody having a bluff surface perpendicular to the injector axis, and axially aligned with the injector discharge plane. In operation the combustion flame tends to remain anchored to the bluff surface, improving the flame's spatial stability and discouraging the flame from migrating into the mixing chamber.

Despite the many merits of the above described injectors, engine manufacturers continue their efforts to perfect and optimize premixing fuel injectors. In particular, manufacturers seek additional ways to eliminate flame from the mixing chamber without increasing exhaust emissions or jeopardizing flame stability.

SUMMARY OF THE INVENTION

It is, therefore, an object of the invention to provide a premixing fuel injector having superior capability to eliminate flame inside the injector's mixing chamber, and to do so without increasing undesirable exhaust emissions or compromising flame stability in the combustion chamber. It is a further object of the invention to avoid introducing undue complexity into the injector or its manufacture.

According to the invention, the fuel injection passages of a tangential entry, premixing fuel injector are oriented and positioned so that if the injector is operating in a degraded state, associated with combustion in the mixing chamber, fuel discharged from the passages is ineffective at sustaining the combustion. According to one aspect of the invention, the fuel injection passages are oriented and positioned so that when the injector operates in the degraded state, fuel jets issuing from the passages impinge on the neighboring scroll rather than penetrating radially to the centerbody. According to another aspect of the invention, the scrolls bordering the air intake slot exert an aerodynamic influence on the fuel jets to limit the radial penetration of the jets when the injector operates in the degraded state.

The primary advantage of the invention is its ability to eliminate flame from the mixing chamber without increasing exhaust emissions, jeopardizing flame stability or introducing undue complexity into the injector or its manufacture.

The foregoing features and advantages and the operation of the invention will become more apparent in light of the following description of the best mode for carrying out the invention and the accompanying drawings.

BEST MODE FOR CARRYING OUT THE INVENTION

This invention is predicated in part on the recognition that:

1. combustion in the mixing chamber of a tangential entry, premixing fuel injector causes the injector to operate in a degraded state characterized by a reduction in the velocity and mass flow rate of a stream of combustion air entering the mixing chamber;
2. the reduced air velocity enables fuel introduced into the airstream to penetrate radially inwardly without being thoroughly mixed with the combustion air; and
3. the non-thoroughly mixed fuel helps to sustain the combustion and inhibits disgorgement of combustion flame from the mixing chamber.

Figure 1:
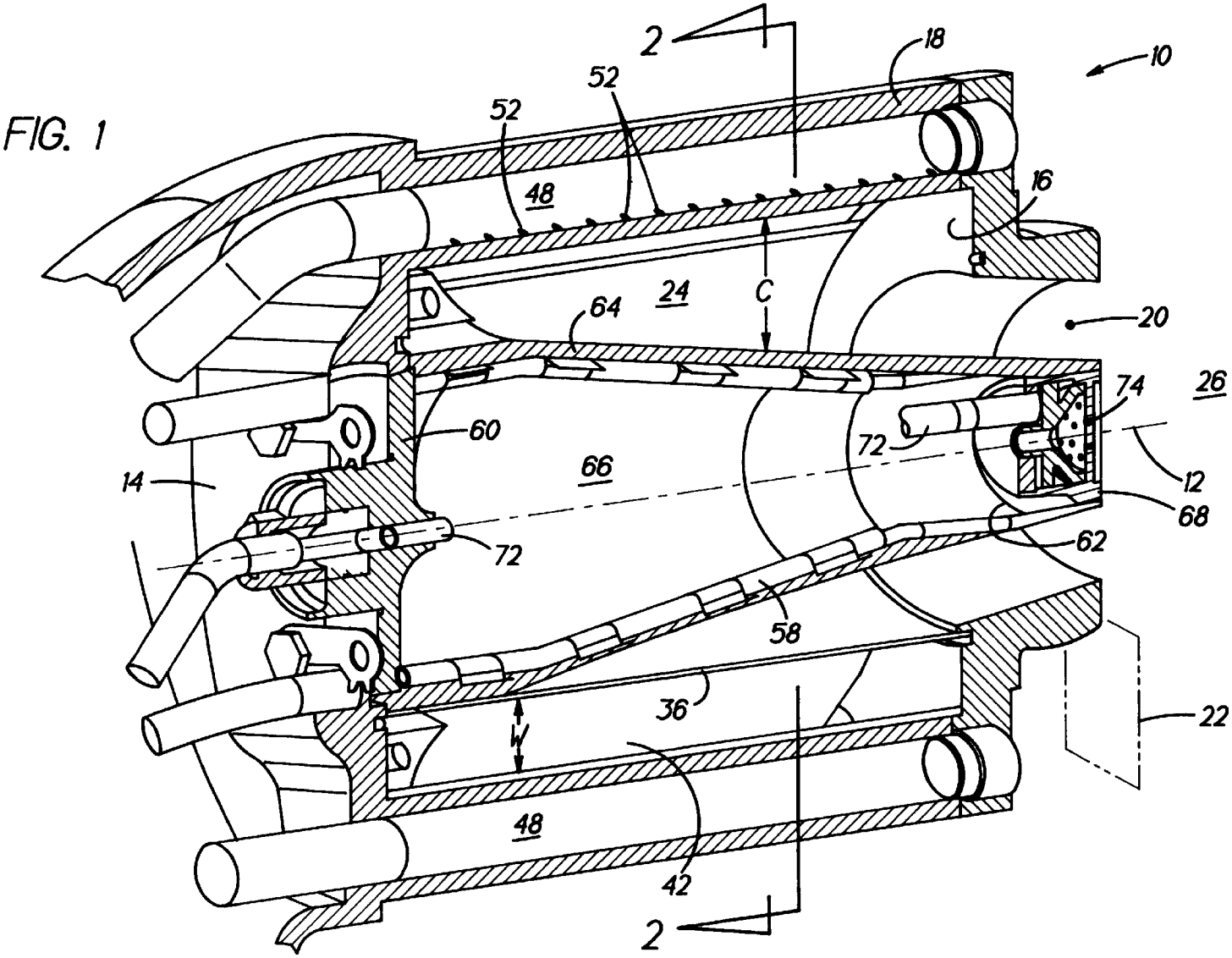
FIG 1 is a perspective, cutaway view of a premixing fuel injector for an industrial gas turbine engine.
Figure 2:
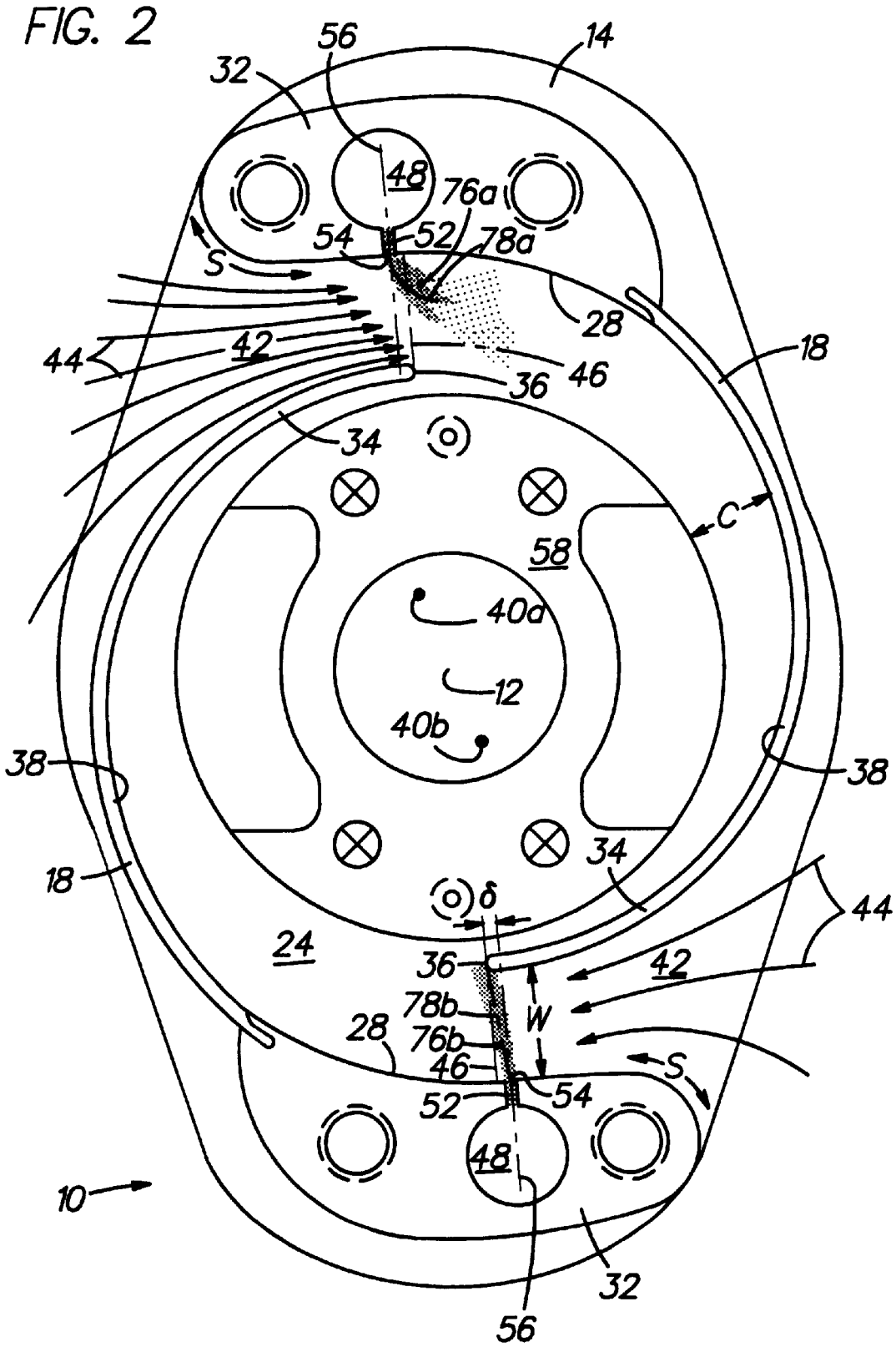
FIG. 2 is a view taken in the direction 2—2 of FIG. 1 showing a fuel passage arrangement embraced by the present invention and illustrating injector operation in both a prescribed state and a degraded state.

FIGS. 1 and 2 illustrate a premixing fuel injector 10 for an industrial gas turbine engine. The injector has an axially extending fuel injector centerline 12 and includes a forward endplate 14, an aft endplate 16, and at least two arcuate scrolls 18 extending axially between the endplates. A fuel injector discharge port 20 extends through the aft endplate, and the aft extremity of the discharge port defines a fuel injector discharge plane 22. The scrolls and endplates bound a mixing chamber 24 that extends axially to the discharge plane and within which fuel and air are premixed prior to being burned in a combustion chamber 26.

Each scroll has a circumferentially leading end 28 distinguished by an enlarged lip 32, and a circumferentially retailing end 34 terminating at a trailing edge 36. Each scroll also has a radially inner surface 38 that faces the fuel injector centerline and defines the radially outer boundary of the mixing chamber. Each inner surface is an arcuate surface, and in particular is a surface of partial revolution about a respective scroll axis 40*a*, 40*b* situated within the mixing chamber. As used herein, the phrase "surface of partial revolution" means a surface generated by rotating a line less than one complete revolution about one of the axes 40*a*, 40*b*. The scroll axes are parallel to and equidistantly radially offset from the fuel injector centerline. Accordingly, the leading end of one scroll cooperates with the trailing end of the neighboring scroll to define the radially inner and outer extremities of an air intake slot 42 for admitting a stream of primary combustion air, indicated by streamlines 44, into the mixing chamber. The radial width W of each slot diminishes with proximity to the mixing chamber so that each slot accelerates the incoming airstream toward a slot discharge plane or throat 46.

The enlarged lip at the leading end of each scroll accommodates a fuel supply manifold 48. An array of fifteen axially distributed fuel injection passages 52 extends from each manifold. Each passage 52 has a discharge opening 54, for introducing a gaseous, primary fuel into the primary combustion air stream 44. The centerlines 56 of the passages 52 are substantially radially oriented.

The scrolls 18 collectively circumscribe a centerbody 58 that extends aftwardly from the forward endplate. The centerbody has a base 60, a nozzle assembly 62 and a shell 64. The shell extends axially from the base to the nozzle assembly to define the radially inner boundary of the mixing chamber 24 and the radially outer boundary of a secondary air supply conduit 66. The shell converges toward the centerline 12 in the aft direction so that the radial clearance space C separating the scroll from the centerbody increases toward the discharge end of the injector. The base 60 includes a series of secondary air supply ports, not visible in the figures, to admit secondary air into the conduit 66. The aft end 68 of the nozzle assembly is bluff, i.e. it is broad and has a flat or gently rounded face, and is substantially axially aligned with the discharge plane 22. A secondary fuel supply tube 72 extends through the centerbody to supply secondary fuel to the nozzle assembly. In the preferred embodiment the secondary fuel is a gaseous fuel. The nozzle assembly includes a set of discharge orifices, such as representative orifice 74, for discharging the secondary fuel and air into the combustion chamber 26.

The injector has a normal or prescribed state of operation illustrated in the top half of FIG. 2. In the prescribed operational state, the combustion airstream 44 enters the injector tangentially (i.e. circumferentially) through each intake slot 42. A high pressure jet of fuel 76*a* issues from each of the fuel passages 52 and is introduced transversely into the incoming airstream. Because the velocity of the incoming air is considerable, the fuel jet 76*a*is deflected circumferentially as indicated by the fuel jet mean trajectory 78*a*. The fuel jet penetrates radially to only about one half of the slot width W before the fuel becomes substantially intermingled with the incoming air. The fuel and air flow into the mixing chamber 24, swirl around the centerbody and become intimately intermixed. The swirling fuel-air mixture also flows axially through the mixing chamber and is ultimately discharged through the discharge port 20 and into the combustion chamber 26.

Figure 3:
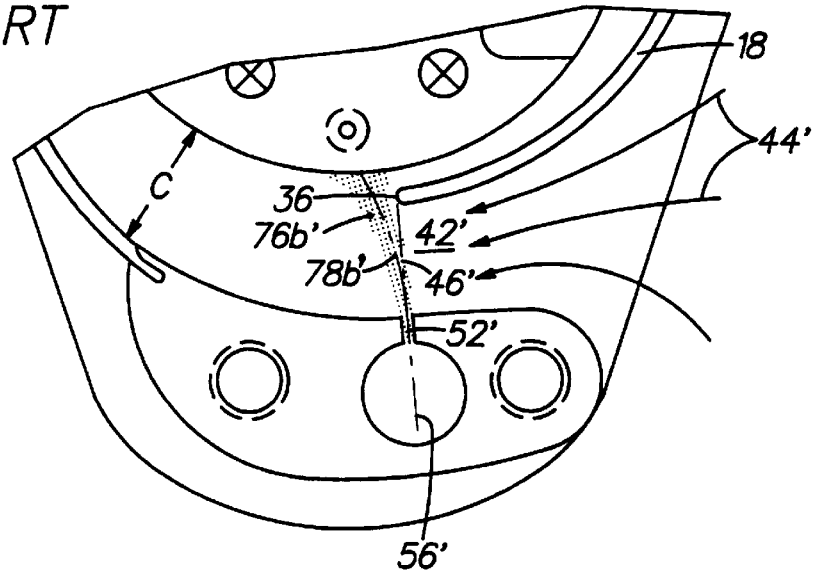
FIG. 3 PRIOR ART
FIG. 3 is a view similar to that of FIG. 2 showing a prior art fuel passage arrangement and illustrating operation of the prior art injector in the degraded state.

The injector also has a degraded state of operation associated with the undesirable presence of combustion inside the mixing chamber 24. The degraded operational state of a prior art fuel injector is illustrated in FIG. 3. In the prior art injector, the centerline 56' of each fuel passage 52' is approximately circumferentially aligned with the trailing edge of 36' of neighboring scroll 18' and with the intake slot discharge plane 46'. In the degraded operational state, the hot combustion products expand inside the mixing chamber, resisting air ingress through the intake slots 42'. As a result, the mass flow rate and velocity of the incoming airstream 44' is considerably diminished in comparison to the prescribed state. Accordingly, the fuel jet 76*b*' remains largely intact and deflects only minimally as indicated by the fuel jet mean trajectory 78*b* '. Near the forward end of the injector, where the radial clearance C between the scroll and the centerbody is small, the intact fuel jest can penetrate radially inwardly into the vicinity of the centerbody where the fuel can locally enrich the fuel-air mixture. The velocity of the fuel-air mixture in the vicinity of the centerbody, and especially near it's forward end, may also be too slow to reliably and effectively disgorge or expel the flame through the injector discharge port. The local enrichment attributable to the radially penetrating fuel jet only exacerbates this condition, helping to sustain the combustion and encourage the combustion flame to remain inside the mixing chamber.

Operation of the inventive fuel injector in the degraded operational state is illustrated in the lower half of FIG. 2. Selected fuel injection passages 52, and preferably all the fuel injection passages, are positioned relative to the trailing end 34 of the neighboring scroll so that the fuel issuing from the passages is ineffective at sustaining combustion inside the mixing chamber for more than a limited interval of time. The length of the time interval depends at least partly on the intensity of the combustion flame and the injector's tolerance to combustion inside the mixing chamber. The time interval should be short enough to preclude damage that would render the injector unsuitable for continued operation. More specifically, the time interval is one short enough that subsequent operation in the prescribe operational state, although compromised, nevertheless exceeds acceptable minimum performance standards. Compromised but acceptable performance is judged according to exhaust emissions, flame stability or other criteria important to the engine manufacturer or owner. In the most stringently defined embodiment, the passages are positioned so that the fuel is completely ineffective at sustaining combustion inside the mixing chamber during operation in the degraded state.

In the illustrated injector, the position of the passages is expressed as an offset distance δ relative to the slot discharge plane. The illustrated passage 52 is positioned so that its discharge opening 54 is circumferentially upstream of the intake slot discharge plane 46. The offset distance δ is at least large enough that the mean trajectory 78*b* of the deflected fuel jet 76*b* grazes the trailing edge 36 of the neighboring scroll when the injector operates in the degraded state. That is, the fuel jet mean trajectory 78*b* extends circumferentially downstream no further than the trailing edge 36 of the neighboring scroll at the radially innermost extremity of the intake slot 42. As a result of this judicious positioning of the passages, the fuel jets 76*b* impinge upon the trailing end of the neighboring scroll, and the neighboring scroll acts as a physical barrier to limit radial penetration of the fuel jets. As a result, the fuel issuing from the passages 52 is unable to appreciably enrich the fuel mixture in the vicinity of the centerbody. In practice the offset distance δ may be made larger than shown in the illustration to account for factors such as manufacturing tolerances and inaccuracies in predicting the degraded mean trajectory 78*b*. However it may be inadvisable to position the passages so far upstream that their discharge openings 54 encroach into a sector S on the scroll lip 32. The sector S is a sector susceptible to fluid separation and turbulence as the combustion airstream 44 flows around the enlarged lip to enter the intake slot 42. Positioning the passage opening in sector S could be detrimental to injector performance in the prescribed operational state.

As described above, the passages are positioned so that the scroll trailing end 34 acts as a physical barrier against radial penetration of the fuel jet issuing from the passage rendering the fuel ineffective at sustaining combustion in the mixing chamber. Alternatively, the passage may be positioned so that the scrolls exert an aerodynamic influence, rather than a physical influence, to prevent excessive radial penetration of the intact fuel jets in the degraded state. For example the passages may be positioned far enough upstream of the slot discharge plane 46 that the incoming air, even in the degraded operational state, has sufficient time to intermingle with the fuel and prevent the introduction of undiluted fuel into the vicinity of the centerbody.

The criticality of the fuel passage position was demonstrated by testing five fuel injectors under conditions representative of those encountered in an engine. Each injector was instrumented with thermocouples to detect the presence of combustion inside the mixing chamber. In each test, fuel and air, in a specified ratio, were supplied to the test injector. An ignition source was used to intentionally initiate combustion inside the injector's mixing chamber. Once combustion was established, the ignition source was disabled and the persistence of the combustion was monitored by observing the thermocouple readings. The experiment was repeated for each injector at various fuel-air ratios to establish a threshold fuel-air ratio below which the injector eliminated the flame within three seconds following disablement of the ignition source. Each threshold fuel-air ratio was then expressed as a "flame disgorgement margin", which is the percentage difference between the threshold fuel-air ratio and a reference fuel-air ratio. A ratio of 0.024 was selected as the reference since 0.024 is the maximum fuel air ratio expected to be experienced in actual service in the prescribed operational state.

Figure 4:
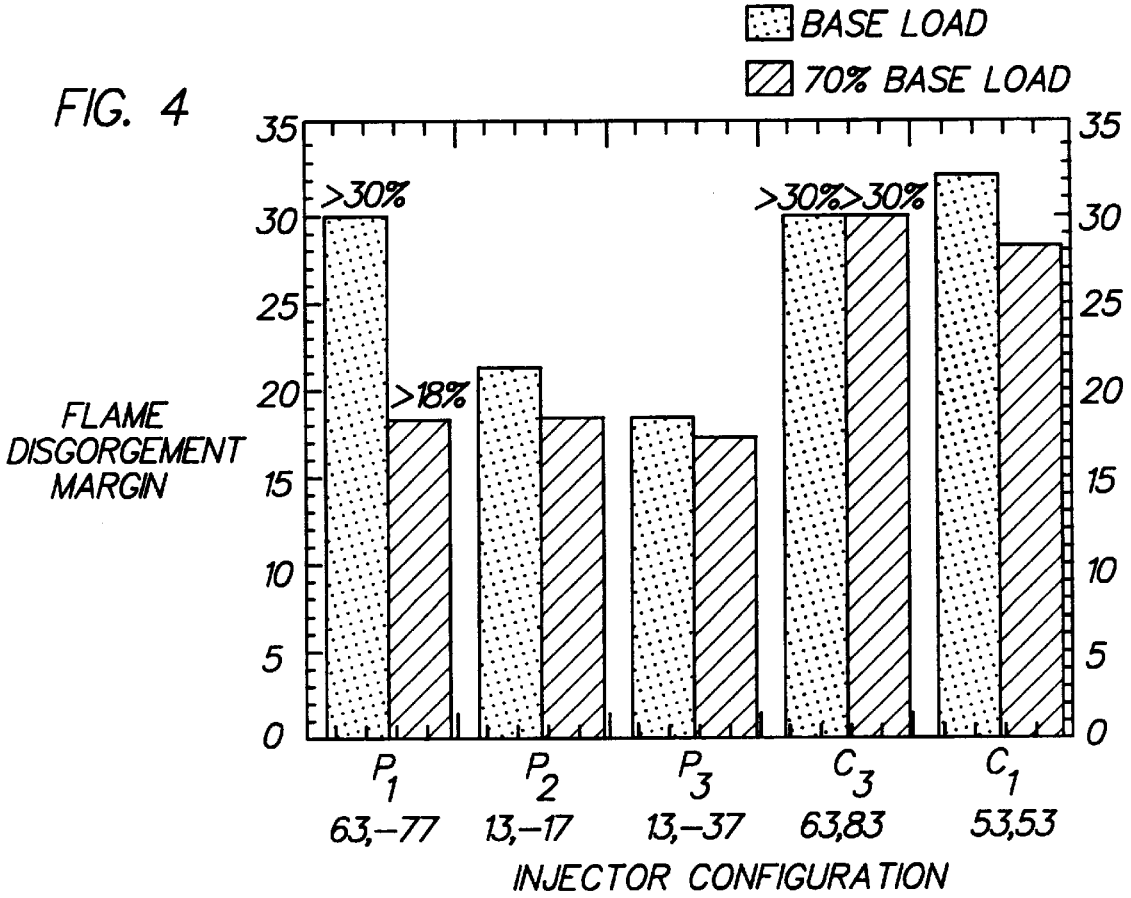
FIG. 4 is a bar graph showing experimental results demonstrating the efficacy and merits of the invention.

The test results displayed in the bar chart of FIG. 4 show the flame disgorgement margin for each of the five injectors at simulated conditions representative of base load (100% rated engine power) and 70% base load. The injector population includes three "parent" injectors, designated $P_1$, $P_2$ and $P_3$, and two "child" injectors designated $C_1$ and $C_3$. Each parent injector is a distinct individual having no hardware components in common with the other two parent injectors. The child injectors are constructed from the same hardware as their respective parents, but with the original fuel injection passages sealed shut and replaced by newly drilled passages. The nominal passage offset distance δ a relative to the intake slot discharge plane (and therefore also relative to the nominal design intent for a prior art injector) is shown in mils (thousandths of an inch) with negative values indicating an offset in the downstream direction (toward the mixing chamber) and positive values indicating an offset in the upstream direction (away from the mixing chamber). For example, the passages in one of the scrolls of injector $P_1$ were offset 77 mils toward the mixing chamber, and the passages in the other scroll of injector $P_1$ were offset 63 mils away from the mixing chamber.

In some of the test events, test facility limitations prevented precise identification of the actual threshold fuel-air ratio. In those cases it was never possible to achieve a fuel-air ratio high enough to make the injector incapable of eliminating the flame within three seconds. Those cases are clearly identified by the inequality labels on the bar chart, indicating that the flame disgorgement margin is at least as great as the height of the corresponding bar.

Injector $P_1$ is an injector known to have exhibited unexpectedly good internal flame/combustion resistance during various development tests. An inspection of the injector revealed that the nominal position of the injector passages deviated significantly (by +63 mils and −77 mils) from the nominal design intent, presumably because the injector had been repeatedly assembled and disassembled during Development. It was speculated that the injector's internal flame resistance may have been attributable to the position of the passages. This speculation led to the discovery that combustion in the mixing chamber strenuously resists air ingress, and that as a result the fuel jets are only minimally deflected so that fuel issuing from passages positioned according to the prior art can penetrate radially far enough to sustain the combustion. The powerful and dramatic influence of these judiciously positioned passages is emphasized by observing that injector $P_1$ exhibits superior margin even though the fuel injection passages on one of the scrolls are considerably offset in the unfavorable direction, i.e. toward the mixing chamber.

Injectors $P_2$ and $P_3$ are conventional injectors whose fuel injection passages are positioned approximately in conformance with the design intent, i.e. approximately aligned with the trailing edge of the neighboring scroll as seen in FIG. 3. Taken together, these injectors exhibited an average disgorgement margin of about 19% (average of 21, 18, 18 and 17). Injectors $C_1$ and $C_3$ are injectors whose fuel injection passages are positioned away from the mixing chamber in accordance with the present invention. These injectors, taken together, exhibited an average margin of no less than 30% since the average margin of $C_1$ is 30% and the average margin of $C_3$ is at least 30%. Thus, it is clear that an injector constructed according to the present invention will have a dramatically improved disgorgement margin—at least 58% higher than that of a conventional injector according to the experimental results.

The preceding description of the invention is directed to a fuel injector whose fuel injection passages are substantially radially oriented. However nonradial orientations may favorably influence the injector's flame disgorgement margin. For example, a passage oriented to inject fuel with a velocity component directed circumferentially away from the mixing chamber may be more effective than a similarly positioned, radially oriented passage.

In the preferred embodiment of the invention, all of the fuel injection passages are oriented and positioned as described above. However the improvement in flame disgorgement margin may be achievable even if fewer than all the passages are positioned and oriented as described. For example a subset of passages near the forward end of the injector are the ones most likely to contribute to sustaining combustion in the injector. Therefore improved internal flame resistance may be achieved even if only the forwardmost subset of passages is oriented and positioned as described herein. However there is no known disadvantage to positioning and orienting the entire array of passages as described, and doing so facilitates simplicity of manufacture.

Although this invention has been shown and described with reference to a detailed embodiment, it will be understood by those skilled in the art that various changes in form and detail may be made without departing from the invention as set forth in the accompanying claims.

We claim:

1. A premixing fuel injector comprising a centerbody and at least two circumferentially neighboring scrolls, each scroll having a circumferentially leading end and a circumferentially trailing end that terminates at a trailing edge, the scrolls collectively circumscribing the centerbody to radially bound a mixing chamber with the leading end of each scroll and the trailing end of the neighboring scroll cooperating to define radially outer and inner extremities of an intake slot for admitting a stream of air into the mixing chamber, the leading end of at least one of the scrolls including an array of axially distributed fuel injection passages each having a discharge opening for introducing fuel into the air stream, the injector having a prescribed state of operation and also being operable in a degraded state associated with combustion inside the mixing chamber, selected fuel injection passages being oriented and positioned upstream relative to the trailing edge of the neighboring scroll so that during operation in the degraded state the fuel issuing therefrom is ineffective at sustaining the combustion inside the mixing chamber for more than a limited period of time at fuel-air ratios below an independently specified threshold.

2. The fuel injector of claim 1 wherein the limited time interval is short enough to preclude damage that renders the injector unsuitable for continued service.

3. The fuel injector of claim 2 wherein the limited time interval is short enough that injector performance, when the injector is subsequently operated in the prescribed operational state, exceeds acceptable minimum standards.

4. The fuel injector of claim 1 wherein the selected fuel injection passages are oriented and positioned so that the fuel issuing therefrom is completely ineffective at sustaining the combustion inside the mixing chamber.

5. The fuel injector of claim 1 wherein the selected fuel injection passages are oriented and positioned so that in the degraded operational state fuel jets issuing from the selected passages follow a mean trajectory that extends circumferentially no further than the trailing edge of the neighboring scroll at the radially inner extremity of the intake slot.

6. The fuel injector of claim 1 wherein the selected fuel injection passages are oriented and positioned so that in the degraded operational state fuel jets issuing from the selected injection passages impinge upon the trailing end of the neighboring scroll.

7. The fuel injector of claim 1 wherein the trailing end of the neighboring scroll acts as a physical barrier to limit radial penetration of fuel jets issuing from the selected fuel injection passages in the degraded operational state.

8. The fuel injector of claim 1 wherein the intake slot terminates at a slot discharge plane, and the selected fuel injection passages are positioned so that their discharge openings are circumferentially upstream of the slot discharge plane.

9. The fuel injector of claim 1 wherein the leading end of at least one scroll and the trailing end of the neighboring scroll exert an aerodynamic influence on fuel jets issuing from the selected fuel injection passages to limit radial penetration of the fuel jets in the degraded operational state.

10. The fuel injector of claim 1 wherein the selected fuel injection passages are positioned and oriented so that fuel jets issuing therefrom in the degraded operational state are incapable of penetrating radially into a region of impaired fluid velocity in the vicinity of the centerbody.

11. The fuel injector of claim 10 wherein the fluid velocity in the impaired velocity region is inadequate for disgorging flame from the mixing chamber.

12. The fuel injector of claim 1 wherein the selected fuel injection passages are oriented to introduce the fuel jets substantially transversely relative to the air stream.

13. A method of operating a premixing fuel injector, the injector having a centerbody and at least two circumferentially neighboring scrolls, each scroll having a circumferentially leading end and a circumferentially trailing end that terminates at a trailing edge, the scrolls collectively circumscribing the centerbody to radially bound a mixing chamber with the leading end of each scroll and the trailing end of the neighboring scroll cooperating to define radially outer and inner extremities of an intake slot for admitting a stream of air into the mixing chamber, the leading end of at least one of the scrolls including an array of axially distributed fuel injection passages for introducing fuel into the air stream, the injector having a prescribed state of operation and a degraded state of operation, the method comprising introducing jets of fuel into the air stream upstream of the trailing edge of the neighboring scroll so that the fuel jets penetrate no more than a limited radial distance into the airstream during operation in the prescribed state and, during operation in the degraded state, are ineffective at sustaining the combustion inside the mixing chamber for more than a limited period of time at fuel air ratios below an independently specified threshold.

* * * * *